US008251137B2

(12) United States Patent
Whiddon et al.

(10) Patent No.: US 8,251,137 B2
(45) Date of Patent: Aug. 28, 2012

(54) GEOMETRICALLY OPTIMIZED EXPANSION CONE

(75) Inventors: Richard Murray Whiddon, Katy, TX (US); Terry Dale Jones, Tomball, TX (US)

(73) Assignee: Enventure Global Technology, LLC, Houston, TX (US)

( * ) Notice: Subject to any disclaimer, the term of this patent is extended or adjusted under 35 U.S.C. 154(b) by 436 days.

(21) Appl. No.: 12/543,809

(22) Filed: Aug. 19, 2009

(65) Prior Publication Data

US 2010/0044030 A1 Feb. 25, 2010

Related U.S. Application Data

(60) Provisional application No. 61/090,378, filed on Aug. 20, 2008.

(51) Int. Cl.
*E21B 23/04* (2006.01)
*B21D 39/08* (2006.01)

(52) U.S. Cl. ..... 166/207; 166/384; 72/370.06

(58) Field of Classification Search ..... 166/217, 166/207, 380, 383, 384, 210, 206; 72/370.06, 72/370.01, 393, 57, 58
See application file for complete search history.

(56) References Cited

U.S. PATENT DOCUMENTS

| | | | | |
|---|---|---|---|---|
| 6,622,797 | B2 | 9/2003 | Sivley, IV | |
| 6,722,427 | B2 * | 4/2004 | Gano et al. | 166/217 |
| 7,048,067 | B1 | 5/2006 | Cook | |
| 7,191,841 | B2 | 3/2007 | Sivley, IV | |
| 7,270,188 | B2 | 9/2007 | Cook | |
| 7,552,776 | B2 | 6/2009 | Noel | |
| 7,712,522 | B2 | 5/2010 | Gray | |

FOREIGN PATENT DOCUMENTS

CN 2886063 Y * 4/2007

* cited by examiner

*Primary Examiner* — Kenneth L Thompson
(74) *Attorney, Agent, or Firm* — Derek V. Forinash; Porter Hedges LLP

(57) ABSTRACT

A geometrically optimized expansion cone for radially expanding a tubular member. In some embodiments, the expansion cone includes an annular body having an outer surface. The outer surface includes a linear surface having a constant diameter, a curvilinear surface extending from the linear surface, a recessed surface having a diameter less than the diameter of the curvilinear surface, and a chamfer between the recessed surface and the curvilinear surface. The diameter of the linear surface is substantially equal to an inner diameter of the tubular member after expansion, while the chamfer has a maximum diameter less than an inner diameter of the tubular member prior to expansion. The curvilinear surface has a diameter defined by a radius of curvature which is tangent to the chamfer at the maximum diameter and tangent to the linear surface.

13 Claims, 3 Drawing Sheets

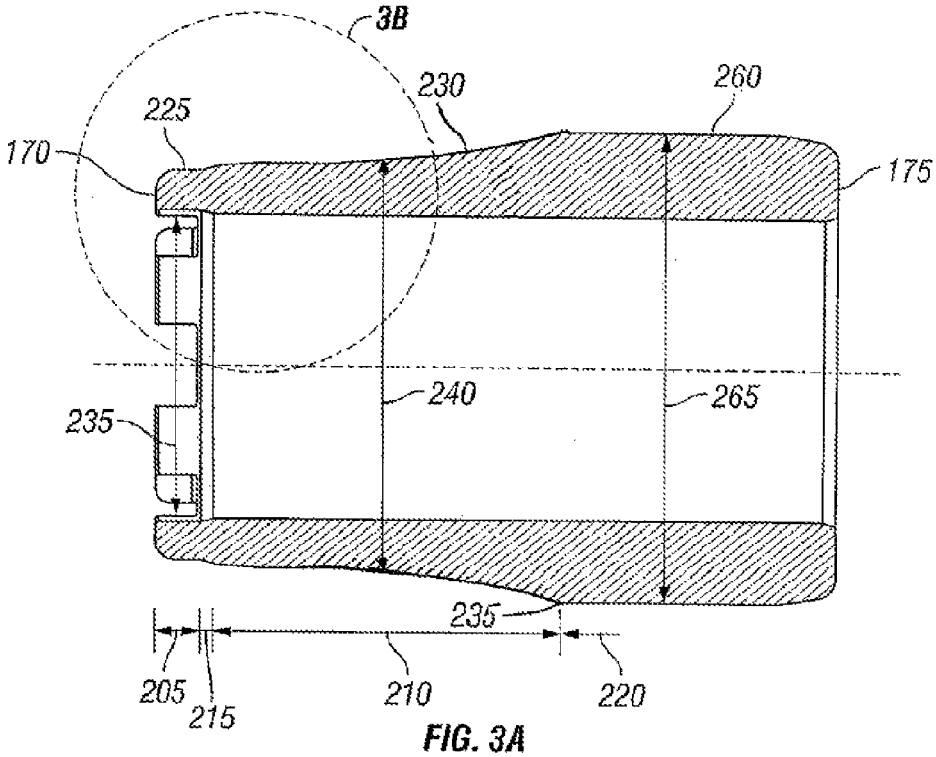
FIG. 3A
Amended

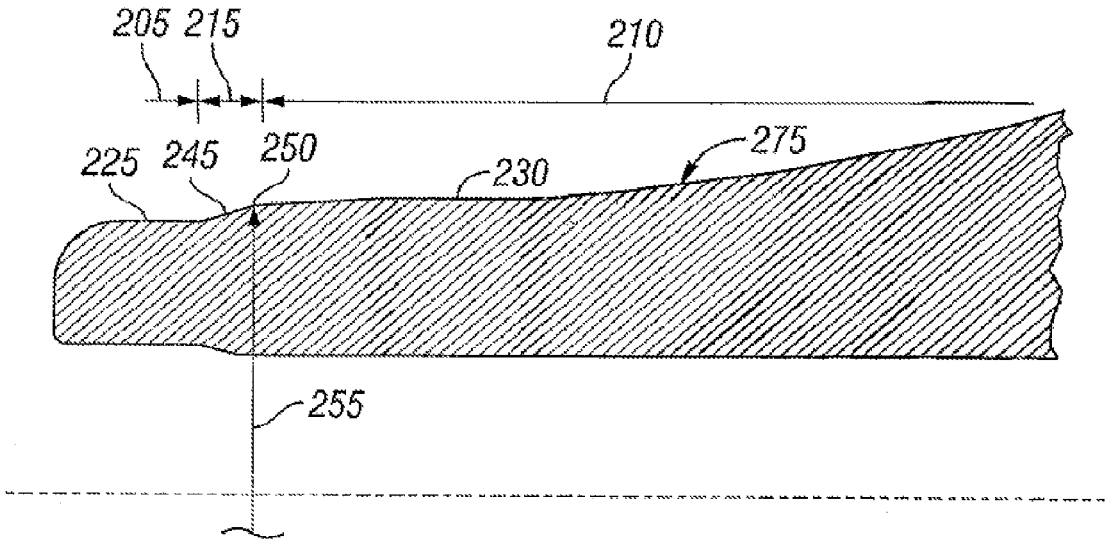
FIG. 3B
Amended

GEOMETRICALLY OPTIMIZED EXPANSION CONE

CROSS-REFERENCE TO RELATED APPLICATIONS

This application claims the benefit of U.S. provisional application Ser. No. 61/090,378 filed Aug. 20, 2008, and entitled "Geometrically Optimized Expansion Cone," which is hereby incorporated herein by reference in its entirety for all purposes.

STATEMENT REGARDING FEDERALLY SPONSORED RESEARCH OR DEVELOPMENT

Not Applicable.

BACKGROUND

1. Field of Art

The present disclosure relates generally to an apparatus for expanding tubular members. More particularly, the present disclosure relates to an expansion cone having a geometry optimized for radial expansion of the tubular members.

2. Description of the Related Art

In the oil and gas industry, expandable tubing is often used for casing, liners and the like. To create a casing, for example, a tubular member is installed in a wellbore and subsequently expanded by displacing an expansion cone through the tubular member. The expansion cone may be pushed or pulled using mechanical means, such as by a support tubular coupled thereto, or driven by hydraulic pressure. As the expansion cone is displaced axially within the tubular member, the expansion cone imparts radial force to the inner surface of the tubular member. In response to the radial load, the tubular member deforms, increasing both its inner and outer diameters. In other words, the tubular member expands radially.

Expanding a tubular member in this manner can be problematic. After expansion, there will be significantly high residual strain in the tubular. In some applications, a casing is formed of a series of tubular members, such as pipe joints, threaded end-to-end and subsequently expanded, as described above. After expansion, there may be significantly high residual stress and strain in one or more of the threaded connections. The higher the residual stress and strain in a threaded connection, the greater the potential for the threaded connection to fail under load.

Accordingly, there is a need for apparatus that minimizes residual stress and strain levels in the expanded tubular.

SUMMARY OF THE DISCLOSED EMBODIMENTS

The embodiments of the present invention are directed toward an expansion cone having a geometry optimized for radial expansion of a tubular member. In some embodiments, the expansion cone includes an annular body having an outer surface. The outer surface includes a linear surface having a constant diameter, a curvilinear surface extending from the linear surface, a recessed surface having a diameter less than the diameter of the curvilinear surface, and a chamfer between the recessed surface and the curvilinear surface. The diameter of the linear surface is substantially equal to an inner diameter of the tubular member after expansion, while the chamfer has a maximum diameter less than an inner diameter of the tubular member prior to expansion. The curvilinear surface has a diameter defined by a radius of curvature which is tangent to the chamfer at the maximum diameter and tangent to the linear surface.

In other embodiments, the expansion cone includes a leading end and an annular body extending from the leading end. The annular body has an outer surface including a first linear surface having a substantially constant diameter, a curvilinear surface extending from the first linear surface, and a recessed surface extending from the curvilinear surface toward the leading end. The diameter of the first linear surface is equal to an inner diameter of the tubular member after expansion. The recessed surface has a diameter that decreases from a maximum limit proximate the curvilinear surface, wherein the maximum limit is less than an inner diameter of the tubular member before expansion. The curvilinear surface has a diameter defined by a radius of curvature which is tangent to the maximum limit of the recessed surface and tangent to the first linear surface.

Some methods of designing an expansion cone for radially expanding a tubular member to form a casing include defining a maximum diameter for a recessed surface, the maximum diameter less than an inner diameter of the tubular member, defining a constant diameter for a linear surface, the constant diameter substantially equal to the inner diameter of the casing, and selecting a radius of curvature which defines a curvilinear surface extending between the recessed surface and the linear surface, whereby the curvilinear surface is tangent to the recessed surface at the maximum diameter and tangent to the linear surface.

Thus, embodiments described herein include a combination of features and advantages intended to address various shortcomings associated with certain prior devices. The various characteristics described above, as well as other features, will be readily apparent to those skilled in the art upon reading the following detailed description of the disclosed embodiments, and by referring to the accompanying drawings.

BRIEF DESCRIPTION OF THE DRAWINGS

For a more detailed description of the disclosed embodiments, reference will now be made to the accompanying drawings, wherein:

FIGS. 3A and 3B are cross-sectional views of the expansion cone of FIG. 1.

DETAILED DESCRIPTION OF THE DISCLOSED EMBODIMENTS

Figure 1:
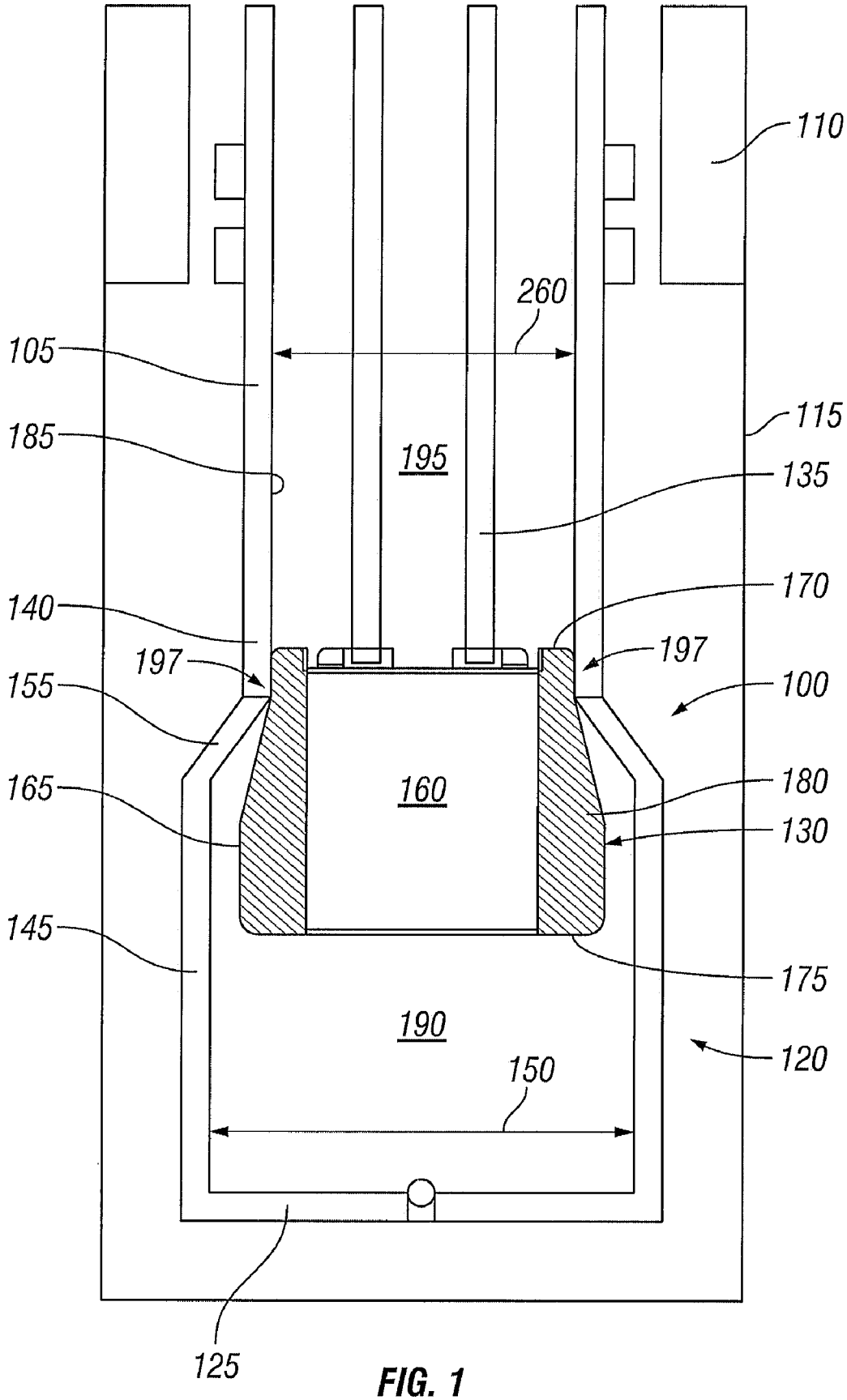
FIG. 1 is a cross-sectional view an expansion cone in accordance with the principles disclosed herein displacing axially under hydraulic pressure to radially expand a surrounding tubular.

Referring now to FIG. 1, an expansion system 100 is shown for radially expanding a tubular member 105 into engagement with a preexisting casing segment 110 to further extend a casing within a wellbore 115. Expansion system 100 includes a cone launcher 120, a shoe 125, a geometrically optimized expansion cone 130 (hereafter "expansion cone" or "cone") in accordance with the principles disclosed herein, and a tubular support member 135. Cone launcher 120 includes an upper portion 140 coupled to tubular member 105, a lower portion 145 having an increased inner diameter 150, relative to that of upper portion 140, for receiving expansion cone 130, and an intermediate portion 155 extending therebetween. Shoe 125 is coupled to lower portion 145 of cone launcher 135.

Expansion cone 130 is suspended by tubular support member 135 within cone launcher 120. Expansion cone 130 includes a first or leading end 170, a second or trailing end 175, and an annular body 180 extending therebetween. Annular body 180 includes a flowbore 160 extending therethrough and an outer surface 165. When outer surface 165 is in sealing engagement with an inner surface 185 of expandable tubular 105, as shown, a chamber 190 is formed by expansion cone 130, cone launcher 135 and shoe 125. Chamber 190 is in fluid communication with flowbore 160 through expansion cone 130 and a flowbore 195 through tubular support member 135. Moreover, the portion of outer surface 165 of cone 130 in sealing engagement with inner surface 185 of tubular 105 is referred to, at least herein, as a cone seal 197.

During radial expansion of tubular 105, fluid is delivered through flowbores 160, 195 to chamber 190. When the pressure of fluid in chamber 190 reaches a sufficient level, the fluid pressure forces expansion cone 130 upward through tubular member 105. As expansion cone 130 is displaced in this manner, expansion cone 130 imparts radial force to inner surface 185 of tubular member 105. In response, tubular member 105 expands in the radial direction, such that its inner and outer diameters are increased.

Figure 2:
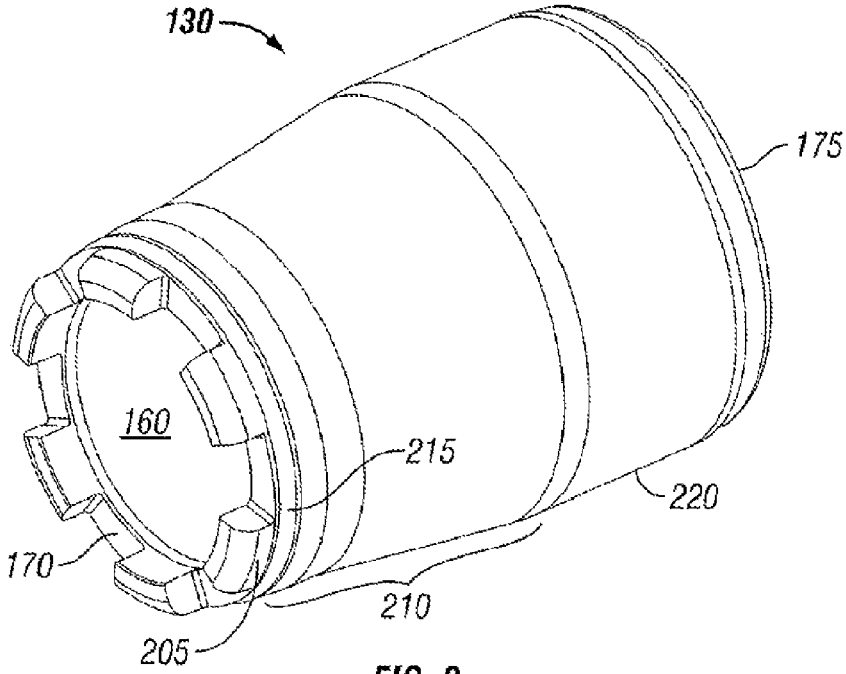
FIG. 2 is a perspective view of the expansion cone of FIG. 1.

Turning next to FIG. 2, outer surface 165 of expansion cone 130 is subdivided into four regions. A recessed region 205 is located proximate leading end 170 of expansion cone 130. A curvilinear region 210 is connected to recessed region 205 by a chamfer 215, best viewed in FIG. 3B. A linear region 220 extends from curvilinear region 210 toward trailing end 175 of expansion cone 130.

Referring now to FIGS. 3A and 3B, recessed region 205 includes an outer surface 225 extending between leading end 170 of expansion cone 130 and chamfer 215. Curvilinear region 210 includes an outer surface 230 extending between chamfer 215 and linear region 220. Outer surface 225 is defined by a diameter 235 that is less than an outer diameter 240 of curvilinear region 210. Thus, region 205 is "recessed" relative to curvilinear region 210. In some embodiments, including those depicted by FIGS. 3A and 3B, diameter 235 is substantially constant over at least a portion of surface 225. In other embodiments, however, diameter 235 may vary along surface 225.

Chamfer 215 provides a transition between recessed region 205 and curvilinear region 210. Chamfer 215 includes an angled, outer surface 245. In some embodiments, including those depicted by FIGS. 3A and 3B, surface 245 is substantially linear. However, in other embodiments, outer surface 245 may be nonlinear. At the transition between chamfer 215 and curvilinear region 210, chamfer 215 is bounded by an edge 250 defined by an outer diameter 255. The maximum limit of outer diameter 255 is dictated by the inner diameter 260 (FIG. 1) of tubular member 105. More specifically, outer diameter 255 is selected such that expansion cone 130 is insertable within tubular member 105, as shown in FIG. 1.

Linear region 220 includes an outer surface 260 having a substantially constant diameter 265. Diameter 265 determines the inner diameter to which tubular member 105 expands as expansion cone 130 is displaced within tubular member 105. For example, if it is desired to expand tubular member 105 such that after expansion, the inner diameter of tubular member 105 is 5.33 inches, diameter 265 of cone 130 is configured to be equal to 5.33 inches. Alternatively, if it is desired to expand tubular member 105 to a smaller inner diameter of 5.25 inches, then cone 130 is configured such that diameter 265 is equal to 5.25 inches.

Outer surface 230 of curvilinear region 210 is defined by a radius of curvature 275, which is selected such that outer surface 230 is tangent to surface 245 of chamfer 215 at edge 250 and tangent to surface 260 of linear region 220. In some embodiments, radius of curvature 275 is equal to 23 inches. The functions of radius of curvature 275 and recessed region 205 are best understood following a brief discussion of tubular expansion using a conventional expansion cone.

Figure 4:
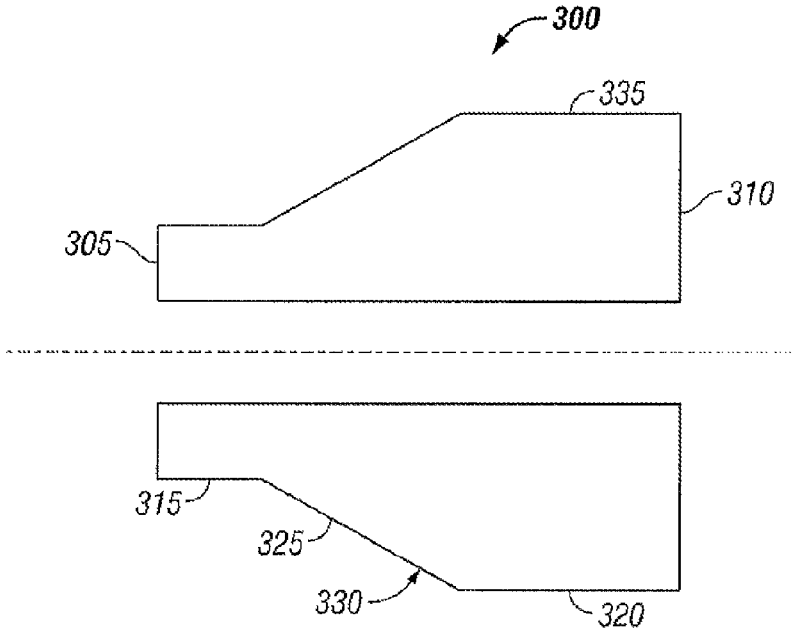
FIG. 4 is a cross-sectional view of a conventional expansion cone.

FIG. 4 illustrates a typical conventional expansion cone 300. Conventional cone 300 includes a leading end 305, a trailing end 310 and an outer surface 335 extending therebetween. Outer surface 335 may be subdivided into a nose 315, a tail 320, defined by a larger diameter than that of nose 315, and an angled surface 325 extending therebetween. During expansion of a tubular member by hydraulic displacement of cone 300 within the tubular, a cone seal forms between the tubular and angled surface 325 in proximity to a location 330 on angled surface 325 that is closer to tail 320 than to nose 315. Due to the location 330 of the cone seal, expansion of the tubular member is not appreciably assisted by hydraulic ballooning, referring to the increased hydraulic pressure load acting on the inner surface of the tubular member. Further, due to linear profile of angled surface 325 of cone 300, expansion of the tubular using cone 300 is a smooth, continuous process as the cone seal "travels" along angled surface 325. However, due to the discontinuities between nose 315 and angled surface 325 and between angled surface 325 and tail 320, the rate of expansion experiences stepwise changes as the cone seal traverses the transitions between these surfaces 315, 325, 320. The location of the cone seal and the less than smooth, continuous nature of the expansion process caused by the discontinuous outer surface 335 of cone 300 yields an expanded tubular with high residual strain, the disadvantage of which was previously described.

Returning to FIG. 3B, recessed region 205 of cone 130 enables a shift of the cone seal location to that location, meaning recessed region 205. Thus, the cone seal is formed at the onset of the expansion process. As such, expansion of a tubular throughwhich cone 130 may be displaced is assisted by hydraulic ballooning. Further, the smooth transitions between regions 205, 215, 210, 220 of cone 130 enable an expansion process substantially free of discontinuities to the rate of expansion, relatively speaking. Still further, the radius of curvature 275 enables that a greater portion of the expansion process occurs in the elastic stage because the length of the curvilinear expansion face, namely outer surface 230, is longer than that of angled surface 325 of conventional cone 300. The combined effect of these structural features yields an expanded tubular with reduced residual stress and strain levels, as compared to those resulting from expansion using a conventional cone. As discussed above, reduction of residual stress and strain in expanded tubulars promotes the structural integrity of the expanded tubular. Also, a faster expansion process is achievable with expansion cone 130, in comparison to that achievable with conventional expansion cones, such as cone 300 shown in FIG. 4.

The benefit of increasing the length of the expansion face of an expansion cone, i.e., lower residual stress and strain in a tubular after expansion by the cone, has been described in the context of a hydraulic expansion cone. Even so, radial expansion of a tubular member using a mechanically driven expansion cone having an expansion face in accordance with the principles described herein, meaning curvilinear like outer surface 230 of cone 130, benefits similarly. Such a mechanically driven cone may be collapsible to be inserted through casing and subsequently expanded prior to expansion of a tubular.

To design a geometrically optimized expansion cone in accordance with the principles described above, including expansion cone 130 of FIGS. 1-3B, outer diameters 255, 265 of the expansion cone are first selected. As described above, outer diameter 255 is selected such that outer diameter 255 is less than the inner diameter of the tubular to be expanded. This allows the expansion cone to be inserted into the unexpanded tubular at the onset of expansion. Outer diameter 265, on the other hand, is configured to be substantially equal to the inner diameter of the tubular after expansion. Thus, if the tubular is to be expanded such that its expanded inner diameter is 5.25 inches, then outer diameter 265 of the expansion cone is configured to be equal to 5.25 inches.

Next, recessed region 205 may be configured. Outer diameter 235 of recessed region 205 is selected such that it is less than outer diameter 250, thereby forming region 205 recessed relative to curvilinear region 210. Once so configured, recessed region 205 shifts the cone seal to this location during the expansion process. Surface 245 of chamfer 215 is then defined to provide a transition between outer surface 225 of recessed region 205 and outer diameter 255. Surface 245 may be linear or nonlinear in profile. Finally, radius of curvature 275 may then be defined such that the curved profile of outer surface 230 is tangent to both edge 250 of chamfer 215 and outer surface 260. In some embodiments, radius of curvature 275 will be significantly larger than outer diameter 265 of the expansion cone in order to be tangential to both edge 250 and outer surface 260.

While preferred embodiments of this invention have been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the methods and apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. An expansion cone for radially expanding a tubular member, the expansion cone comprising:

an annular body having an outer surface, the outer surface comprising:

a linear surface having a constant diameter substantially equal to an inner diameter of the tubular member after expansion;

a curvilinear surface extending from the linear surface, the curvilinear surface having a diameter partially defined by a radius of curvature;

a recessed surface having a diameter less than the diameter of the curvilinear surface; and a chamfer between the recessed surface and the curvilinear surface, the chamfer having a maximum diameter less than an inner diameter of the tubular member prior to expansion; wherein the curvilinear surface is tangent to the chamfer at the maximum diameter and tangent to the linear surface.

2. The expansion cone of claim 1, wherein the chamfer comprises an outer surface having a diameter that decreases from the maximum diameter proximate the curvilinear surface to a minimum diameter proximate the recessed surface.

3. The expansion cone of claim 2, wherein the outer surface of the chamfer is linear in profile.

4. The expansion cone of claim 2, wherein the outer surface of the chamfer is curved.

5. The expansion cone of claim 1, wherein at least a portion of the recessed surface has a constant diameter.

6. The expansion cone of claim 1, wherein the radius of curvature is substantially equal to 23 inches.

7. An expansion cone for radially expanding a tubular member, the expansion cone comprising:

a leading end; and an annular body extending from the leading end, the annular body having an outer surface comprising:

a first linear surface having a substantially constant diameter equal to an inner diameter of the tubular member after expansion;

a curvilinear surface extending from the first linear surface, the curvilinear surface having a diameter partially defined by a radius of curvature; and a recessed surface extending from the curvilinear surface toward the leading end, the recessed surface having a diameter that decreases from a maximum limit proximate the curvilinear surface, wherein the maximum limit is less than an inner diameter of the tubular member before expansion; wherein the curvilinear surface is tangent to the maximum limit of the recessed surface and tangent to the first linear surface.

8. The expansion cone of claim 7, wherein the recessed surface comprises: a second linear surface having a substantially constant diameter which is smaller than the maximum limit; and a chamfer extending between the second linear surface and the curvilinear surface.

9. The expansion cone of claim 8, wherein the chamfer comprises an outer surface that is linear in profile.

10. The expansion cone of claim 8, wherein the radius of curvature is substantially equal to 23 inches.

11. A method of designing an expansion cone for radially expanding a tubular member to form a casing, the method comprising:

defining a maximum diameter for a recessed surface, the maximum diameter less than an inner diameter of the tubular member;

defining a constant diameter for a linear surface, the constant diameter substantially equal to the inner diameter of the casing; and selecting a radius of curvature which defines a portion of a curvilinear surface extending between the recessed surface and the linear surface, whereby the curvilinear surface is tangent to the recessed surface at the maximum diameter and tangent to the linear surface.

12. The method of claim 11, further comprising tapering the recessed surface from a location of the maximum diameter toward a leading end of the expansion cone.

13. The method of claim 12, wherein the tapering comprises forming a chamfer having an outer surface extending from the location of the maximum diameter to a substantially linear portion of the recessed surface having a diameter less than the maximum diameter.

* * * * *